US008231450B2

(12) United States Patent
Larsen

(10) Patent No.: US 8,231,450 B2
(45) Date of Patent: Jul. 31, 2012

(54) GAMING SYSTEM, GAMING DEVICE, AND METHOD FOR PROVIDING AN AWARD ENHANCEMENT FEATURE

(75) Inventor: Kurt M. Larsen, Reno, NV (US)

(73) Assignee: IGT, Reno, NV (US)

( * ) Notice: Subject to any disclaimer, the term of this patent is extended or adjusted under 35 U.S.C. 154(b) by 930 days.

(21) Appl. No.: 12/270,458

(22) Filed: Nov. 13, 2008

(65) Prior Publication Data

US 2010/0120504 A1 May 13, 2010

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2006.01) |

(52) U.S. Cl. ..... 463/20

(58) Field of Classification Search ..... 463/20
See application file for complete search history.

(56) References Cited

U.S. PATENT DOCUMENTS

| | | | |
|---|---|---|---|
| 5,505,461 | A | 4/1996 | Bell et al. |
| 6,077,163 | A | 6/2000 | Walker et al. |
| 6,168,523 | B1 | 1/2001 | Piechowiak et al. |
| 6,296,569 | B1 | 10/2001 | Congello, Jr. |
| 6,308,953 | B1 | 10/2001 | Nagano |
| 6,312,333 | B1 | 11/2001 | Acres |
| 6,319,127 | B1 | 11/2001 | Walker et al. |
| 6,375,187 | B1 | 4/2002 | Baerlocher |
| 6,454,651 | B1 | 9/2002 | Yoseloff |
| 6,494,785 | B1 | 12/2002 | Gerrard et al. |
| 6,506,118 | B1 | 1/2003 | Baerlocher et al. |
| 6,514,141 | B1 | 2/2003 | Kaminkow et al. |
| 6,569,015 | B1 | 5/2003 | Baerlocher et al. |
| 6,589,114 | B2 | 7/2003 | Rose |
| 6,599,192 | B1 | 7/2003 | Baerlocher et al. |
| 6,632,141 | B2 | 10/2003 | Webb et al. |
| 6,648,754 | B2 | 11/2003 | Baerlocher et al. |
| 6,663,489 | B2 * | 12/2003 | Baerlocher ..... 463/20 |
| 6,692,355 | B2 | 2/2004 | Baerlocher et al. |
| 6,719,632 | B2 | 4/2004 | Palmer et al. |
| 6,722,981 | B2 | 4/2004 | Kaminkow et al. |
| 6,722,982 | B2 | 4/2004 | Kaminkow et al. |
| 6,749,504 | B2 | 6/2004 | Hughs-Baird |
| 6,758,750 | B2 | 7/2004 | Baerlocher et al. |
| 6,786,820 | B2 | 9/2004 | Gerrard et al. |
| 6,793,579 | B2 | 9/2004 | Baerlocher et al. |
| 6,796,905 | B2 | 9/2004 | Baerlocher et al. |
| 6,808,452 | B2 | 10/2004 | Baerlocher et al. |
| 6,808,454 | B2 | 10/2004 | Gerrard et al. |
| 6,811,483 | B1 | 11/2004 | Webb et al. |
| 6,852,030 | B2 | 2/2005 | Baerlocher et al. |
| 6,857,961 | B2 | 2/2005 | Soltys et al. |
| 6,890,257 | B2 | 5/2005 | Baerlocher |
| 6,899,623 | B2 | 5/2005 | Baerlocher |
| 6,942,566 | B2 | 9/2005 | Baerlocher et al. |
| 6,942,567 | B2 | 9/2005 | Baerlocher et al. |
| 6,960,132 | B2 | 11/2005 | Baerlocher et al. |
| 6,966,833 | B2 | 11/2005 | Kaminkow et al. |

(Continued)

*Primary Examiner* — Dmitry Suhol
*Assistant Examiner* — Kevin Y Kim
(74) *Attorney, Agent, or Firm* — Neal, Gerber & Eisenberg LLP

(57) ABSTRACT

The gaming system, gaming device and method disclosed herein provide an award enhancement feature that enables a player to obtain a round up factor for an award. The award enhancement feature of the present disclosure enables increasing the value of an award by rounding the award value up to a higher value based on the award value and the round up factor.

19 Claims, 12 Drawing Sheets

U.S. PATENT DOCUMENTS

| | | | |
|---|---|---|---|
| 6,971,953 | B2 | 12/2005 | Gerrard et al. |
| 6,984,175 | B2 | 1/2006 | Nguyen et al. |
| 6,991,544 | B2 | 1/2006 | Soltys et al. |
| 7,001,273 | B2 | 2/2006 | Baerlocher |
| 7,004,466 | B2 | 2/2006 | Gauselmann |
| 7,025,674 | B2 | 4/2006 | Adams et al. |
| 7,040,984 | B2 | 5/2006 | Mead |
| 7,140,964 | B2 | 11/2006 | Walker et al. |
| 7,156,739 | B2 | 1/2007 | Walker et al. |
| 7,160,186 | B2 | 1/2007 | Cuddy et al. |
| 7,172,506 | B2 | 2/2007 | Baerlocher et al. |
| 7,192,349 | B2 | 3/2007 | Baerlocher et al. |
| 7,235,010 | B2 | 6/2007 | Baerlocher |
| 7,250,001 | B2 | 7/2007 | Baerlocher et al. |
| 7,264,545 | B2 | 9/2007 | Maya et al. |
| 7,270,604 | B2 | 9/2007 | Gerrard et al. |
| 7,306,518 | B2 | 12/2007 | Hughs-Baird et al. |
| 7,371,174 | B2 | 5/2008 | Baerlocher |
| 7,377,849 | B2 | 5/2008 | Baerlocher et al. |
| 7,402,103 | B2 | 7/2008 | Baerlocher |
| 2001/0051540 | A1 | 12/2001 | Hindman et al. |
| 2002/0032049 | A1 | 3/2002 | Walker et al. |
| 2003/0013521 | A1 | 1/2003 | Cole et al. |
| 2003/0040360 | A1 | 2/2003 | Kaminkow |
| 2003/0078093 | A1 | 4/2003 | Simms |
| 2003/0083126 | A1 | 5/2003 | Paulsen |
| 2003/0104862 | A1 | 6/2003 | Acres |
| 2003/0162584 | A1 | 8/2003 | Hughs-Baird et al. |
| 2003/0162588 | A1 | 8/2003 | Brosnan et al. |
| 2004/0010556 | A1 | 1/2004 | Kawakita et al. |
| 2004/0082378 | A1 | 4/2004 | Peterson et al. |
| 2004/0106444 | A1 | 6/2004 | Cuddy et al. |
| 2004/0110554 | A1 | 6/2004 | Bromfield |
| 2004/0162128 | A1 | 8/2004 | Baerlocher et al. |
| 2005/0020342 | A1 | 1/2005 | Palmer et al. |
| 2005/0025196 | A1 | 2/2005 | Chang |
| 2005/0049039 | A1 | 3/2005 | Webb et al. |
| 2005/0054413 | A1 | 3/2005 | Randall et al. |
| 2005/0054430 | A1 | 3/2005 | Pitman et al. |
| 2005/0130729 | A1 | 6/2005 | Baerlocher et al. |
| 2005/0170884 | A1 | 8/2005 | Okada |
| 2006/0035706 | A1 * | 2/2006 | Thomas et al. ..... 463/27 |
| 2006/0172791 | A1 | 8/2006 | Wolf |
| 2006/0178198 | A1 | 8/2006 | Fasbender et al. |
| 2007/0060300 | A1 | 3/2007 | Baerlocher |
| 2007/0087809 | A1 | 4/2007 | Baerlocher |
| 2007/0135206 | A1 | 6/2007 | Inamura |

* cited by examiner

FIG. 5A

200a

| FREE ACTIVATION | INITIAL BONUS AWARD VALUE | FINAL BONUS AWARD VALUE |
|---|---|---|
| 1 | $1.50 | |
| 2 | $5.25 | |
| 3 | $3.75 | |
| 4 | $10.45 | |
| 5 | $16.00 | |
| TOTAL FOR ENTIRE BONUS EVENT | $36.95 | $40.00 |

FIG. 5B

200b

| FREE ACTIVATION | INITIAL BONUS AWARD VALUE | FINAL BONUS AWARD VALUE |
|---|---|---|
| 1 | $1.50 | $5.00 |
| 2 | $5.25 | $10.00 |
| 3 | $3.75 | $5.00 |
| 4 | $10.45 | $15.00 |
| 5 | $16.00 | $20.00 |
| TOTAL FOR ENTIRE BONUS EVENT | $36.95 | $55.00 |

GAMING SYSTEM, GAMING DEVICE, AND METHOD FOR PROVIDING AN AWARD ENHANCEMENT FEATURE

COPYRIGHT NOTICE

A portion of the disclosure of this patent document contains material which is subject to copyright protection. The copyright owner has no objection to the photocopy reproduction of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and based on the amount of the wager (e.g., the higher the wager, the higher the award). Symbols or symbol combinations which are less likely to occur usually provide higher awards.

Secondary or bonus games are also known in gaming machines. The secondary or bonus games usually provide an additional award to the player. Secondary or bonus games typically do not require an additional wager by the player to be activated.

One way to enhance enjoyment and excitement is by providing secondary or bonus games in which players have the opportunity to win potentially large awards or credits in addition to the awards associated with the base games of the gaming devices. One such secondary or bonus game for slot games provides a player one or more free activations or free spins. In these gaming devices, upon an occurrence of a triggering event in the primary game, the gaming device provides a free activation game or sequence wherein one or more free activations of the reels are provided to the player. The player plays the free activation game or sequence, likely receives one or more awards during one or more of the free activations and returns to the primary game.

Players enjoy playing for high awards. Thus, to increase player enjoyment and excitement, a continuing need exists to provide new games and game features for gaming devices that provide players with the potential to win large awards.

SUMMARY

Various embodiments of the present disclosure provide a gaming system, a gaming device, and a method for operating a gaming device or gaming system which provides an award enhancement feature that enables a player to obtain a round up factor for an award. More specifically, the award enhancement feature of the present disclosure enables increasing the value of an award by rounding the award value up to a higher value based on the award value and the round up factor. In one embodiment, the award enhancement feature enables enhancing an award obtained in a secondary or bonus game. In other embodiments, in addition to or instead of being employed to enhance an award obtained in a secondary or bonus game as disclosed herein, the award enhancement feature could be implemented to enhance an award won in a primary or base game.

In one embodiment, the gaming system includes a primary or base game operable upon a wager by a player. The gaming system further includes a bonus event which is triggered upon a designated triggering event. In operation, the gaming system enables the player to make a wager on a play of a primary game. The gaming system generates and displays a primary game outcome and provides the player with any primary game awards associated with the primary game outcome. If the designated triggering event occurs, the bonus event initiates. The gaming system determines whether to provide the player with an award enhancement feature for the bonus event. If the determination is to provide the award enhancement feature to the player, the gaming system selects or causes a selection of a round up factor from a plurality of round up factors. Each round up factor is associated with a set of multiples, wherein each of multiples in the set of multiples is the product of the roundup factor and any other whole number. For example, a round up factor of one is associated with a set of multiples which includes the numbers 1, 2, 3, 4, . . . 1n. A round up factor of three is associated with a set of multiples which includes the numbers 3, 6, 9, 12, . . . , 3n. A round of factor of five is associated with a set of multiples which includes the numbers 5, 10, 15, 20, . . . , 5n. After the gaming system determines the round up factor for the bonus event, the gaming system generates and displays an outcome for the bonus event. The gaming system determines an initial bonus award value based on the generated bonus event outcome. The gaming system utilizes the initial bonus award value and the determined round up factor to determine an enhanced bonus award value to be provided to the player.

In one embodiment, the gaming system determines the enhanced bonus award value by rounding the initial bonus award value up to a next higher multiple of the selected round up factor. For example, if a round up factor of three is selected for the bonus event and the outcome of the bonus event is associated with in an initial bonus award value of $10.00, the gaming system determines an enhanced bonus award value by rounding the initial bonus award value of $10.00 up to the next higher multiple of the selected round up factor of three. The next higher multiple (relative to the $10.00 initial bonus award value) in the set of multiples corresponding to the round up factor of three is twelve. Thus, in this example, the gaming system rounds the initial bonus award value of $10.00 up to $12.00 and provides the enhanced bonus award value of $12.00 to the player.

Accordingly, in these embodiments, obtaining a round up factor for the bonus event enables a player to receive an enhanced bonus award. It should be appreciated that, in such embodiments, when the player obtains the round up factor for the bonus event, the round up factor does not apply to any award(s) won in the primary game. Rather, the round up factor takes effect in the bonus event to enhance any bonus award resulting from the bonus event. In other embodiments, the round up factor could apply to any award(s) won in the primary game. That is, obtaining the round up factor enables the player to receive an enhanced primary game award.

In one embodiment, the gaming system determines whether a player will obtain the award enhancement feature for the bonus event based on the player's primary game wager. In one such embodiment, the gaming system provides the award enhancement feature for the bonus event if the player's primary game wager meets a designated wager level. In one such embodiment, the player must be betting the maximum wager amount to obtain the award enhancement feature for the bonus event. In one embodiment, to obtain the bonus award enhancement feature for the bonus event, the player must place a separate side wager in addition to the primary game wager.

In one alternative embodiment, the gaming system determines whether a player will obtain the award enhancement feature based on player status, such as via a player tracking system. For example, a player having gold status obtains the award enhancement feature each time the bonus event is triggered, while a player having bronze status does not always obtain the award enhancement feature when the bonus event is triggered. It should thus be appreciated that the gaming system may determine whether to provide a particular player with the award enhancement feature in any suitable manner.

If the determination is to provide a player with the award enhancement feature for the bonus event, the gaming device selects (or causes a selection of) the round up factor that will apply in the bonus event in any suitable manner. In various embodiments, the selected round up factor is an integer, such as one, two, three, five, or ten, or the round up factor is a fractional amount. For example, if a player is provided with a round up factor of one and wins an initial bonus award value of $6.50 in the bonus event, the enhanced bonus award value provided to the player is $7.00. The initial bonus award value of $6.50 is rounded up to the next dollar amount that is a multiple of one, or $7.00. If the round up factor is 1/100, the initial bonus award value of $6.50 is rounded up to $6.51. In this case, the initial bonus award value of $6.50 is rounded up to the next penny. It should be appreciated that the amount by which the initial bonus award value changes depends on both the round up factor selected for the bonus event and the initial bonus award value. It should also be appreciated that when the initial bonus award value changes, this may cause one, more or all of the digits of the initial bonus award value to change.

In one example embodiment, the gaming system enables the player to participate in a separate event or sequence to determine what the round up factor will be for the bonus event. In one example embodiment, after the bonus event is triggered, the gaming system displays a plurality of masked selections to the player. Each of the masked selections is respectively associated with a round up factor. The gaming system enables the player to select one of the masked selections. After the player selects one of the masked selections, the hidden round up factor associated with the picked selection is revealed and subsequently applied in the bonus event.

In one embodiment, the bonus event includes a number of free activations of a game. For example, the bonus event includes one, two, five, or ten free spins or activations of a slot game. In one such embodiment, if the player obtains a round up factor for the free activations bonus event, the round up factor applies to any bonus award value resulting from each free activation in the bonus event. That is, after each free activation occurs, any bonus award value generated as a result of that free activation is rounded up to the next higher multiple of the applicable round up factor. In another embodiment which includes a free activation bonus event, the round up factor is applied to the total value of all bonus awards accumulated during the free activation bonus event. That is, at the end of the free activation bonus event (i.e., when all of the free spins are complete), the total value of all the bonus awards accumulated in those free activations is rounded up to the next higher multiple of the round up factor.

It is therefore an advantage of the present disclosure to provide a gaming device which provides larger awards in bonus games.

Additional features and advantages of the present invention are described in, and will be apparent from, the following Detailed Description of the Invention and the figures.

BRIEF DESCRIPTION OF THE FIGURES

FIG. 5A provides a table illustrating the results of one example bonus event wherein a player is provided with five free activations of the reels.

FIG. 5B provides a table illustrating the results of another example bonus event wherein a player is provided with five free activations of the reels.

DETAILED DESCRIPTION

The present disclosure may be implemented in various configurations for gaming machines or gaming devices, including but not limited to: (1) a dedicated gaming machine or gaming device, wherein the computerized instructions for controlling any games (which are provided by the gaming machine or gaming device) are provided with the gaming machine or gaming device prior to delivery to a gaming establishment; and (2) a changeable gaming machine or gaming device, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by at least one central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
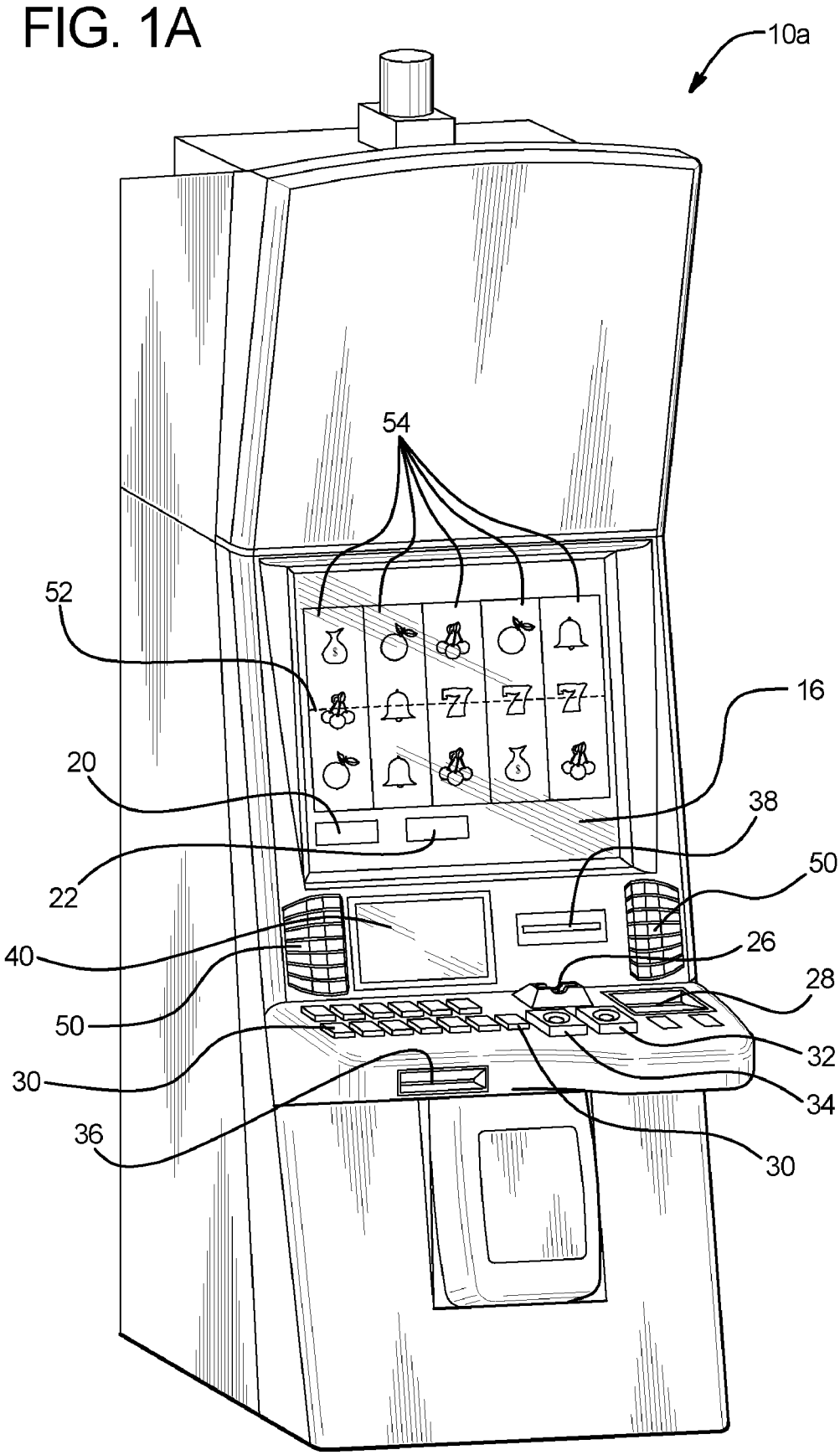
FIGS. 1A and 1B are perspective views of example alternative embodiments of the gaming device of the present disclosure.
Figure 1B:
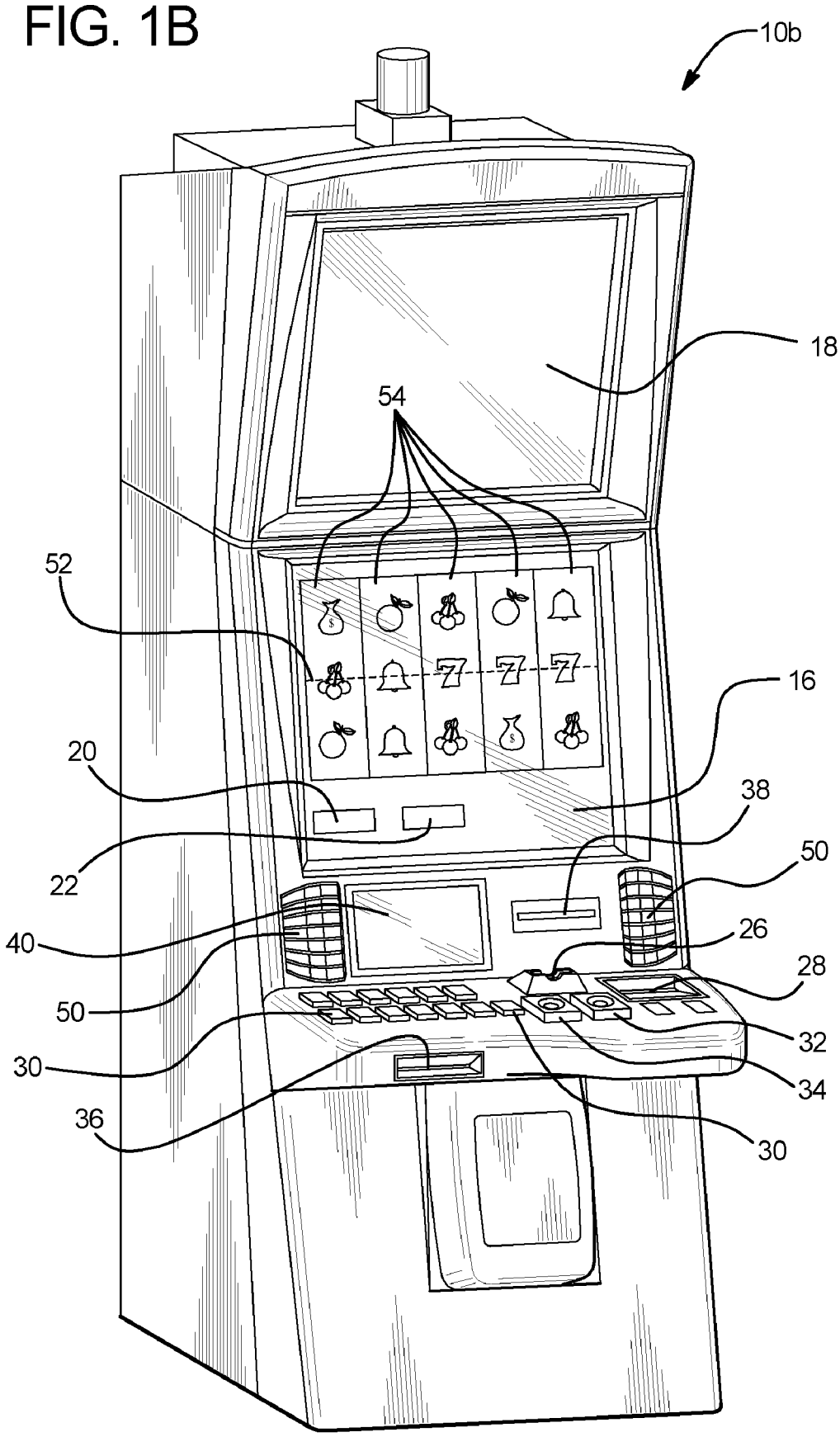

Referring now to the drawings, two example alternative embodiments of the gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
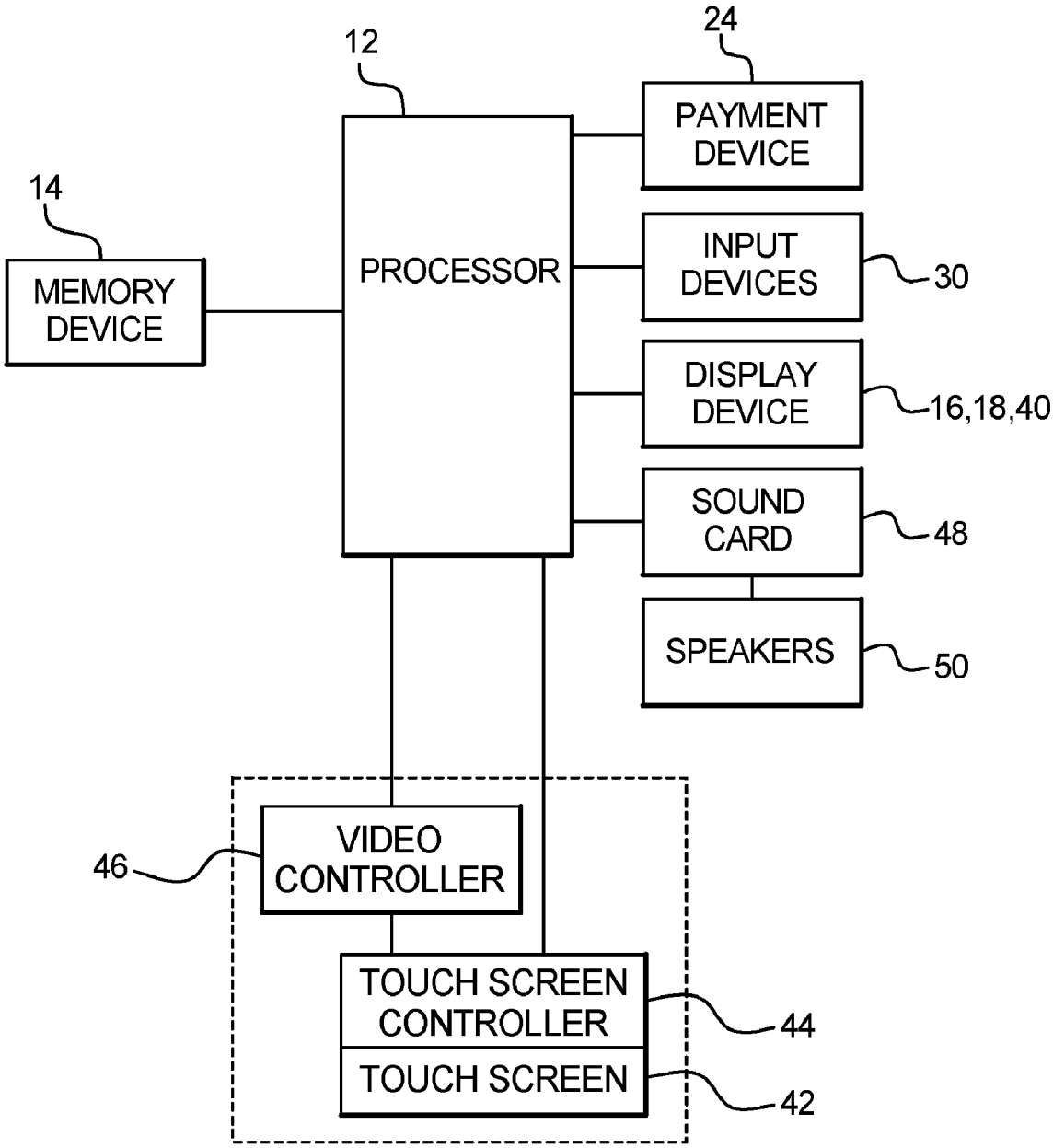
FIG. 2A is a schematic block diagram of one embodiment of an electronic configuration for one of the gaming devices disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, the gaming device includes a bet display 22 which displays a player's amount wagered. In one embodiment, as described in more detail below, the gaming device includes a player tracking display 40 which displays information regarding a player's playing tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. The display device may include any electromechanical device, such as one or more mechanical objects, such as one or more rotatable wheels, reels or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card may be implemented in accordance with the gaming device disclosed herein.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a conventional touch-screen button panel.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary game. The gaming machine or device may include some or all of the features of conventional gaming machines or devices. The primary game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, display the plurality of simulated video reels 54. Each reel 54 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the players selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, as described below, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition may be by exceeding a certain amount of game play (such as number of games, number of credits, amount of time), or reaching a specified number of points earned during game play.

In another embodiment, if the player has not enrolled in the bonus event participation program (as described below), the gaming device processor 12 or central server 56 randomly provides the player one or more plays of one or more secondary games. In one such embodiment, the gaming device does not provide any apparent reasons to the player for qualifying to play a secondary game. In this embodiment, qualifying for a secondary game may not be triggered by an event in or based specifically on any of the plays of any primary game. The gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, if the player has not enrolled in the bonus event participation program (as described below), the gaming device includes a program which will automatically begin a secondary game after the player has achieved a triggering event or qualifying condition in the primary game. In another embodiment, after a player has qualified for a secondary game, the player may subsequently enhance his/her secondary game participation through continued play on the primary game. Thus, for each secondary game qualifying event, such as a secondary game symbol, that the player obtains, a given number of secondary game wagering points or credits may be accumulated in a "secondary game meter" programmed to accrue the secondary game wagering credits or entries toward eventual participation in a secondary game. The occurrence of multiple such secondary game qualifying events in the primary game may result in an arithmetic or exponential increase in the number of secondary game wagering credits awarded. In one embodiment, the player may redeem extra secondary game wagering credits during the secondary game to extend play of the secondary game.

In one embodiment, no separate entry fee or buy in for a secondary game need be employed. In this embodiment, a player may not purchase an entry into a secondary game, rather they must win or earn entry through play of the primary game thus, encouraging play of the primary game. In another embodiment, qualification of the secondary game is accomplished through a simple "buy in" by the player, for example, if the player has been unsuccessful at qualifying through other specified activities. In another embodiment, the player must make a separate side-wager on the secondary game or wager a designated amount in the primary game to qualify for the secondary game. In this embodiment, the secondary game triggering event must occur and the side-wager (or designated primary game wager amount) must have been placed to trigger the secondary game.

Figure 2B:
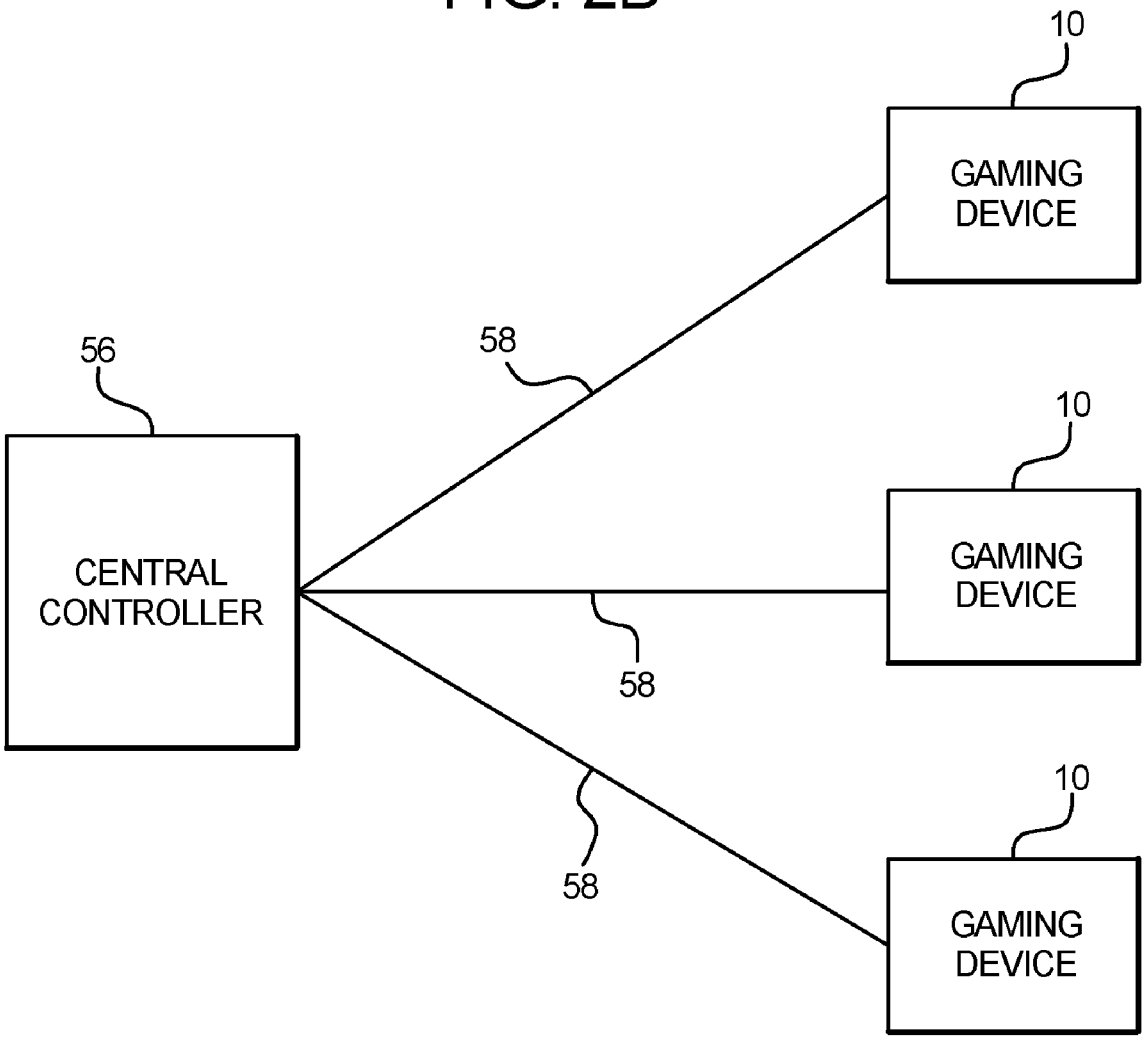
FIG. 2B is a schematic block diagram of one embodiment of a network configuration for a plurality of gaming devices disclosed herein.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo, keno or lottery game. In this embodiment, each individual gaming device utilizes one or more bingo, keno or lottery games to determine the predetermined game outcome value provided to the player for the interactive game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any players gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the players wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Bonus Award Enhancement Feature Example Embodiment

Figure 3:
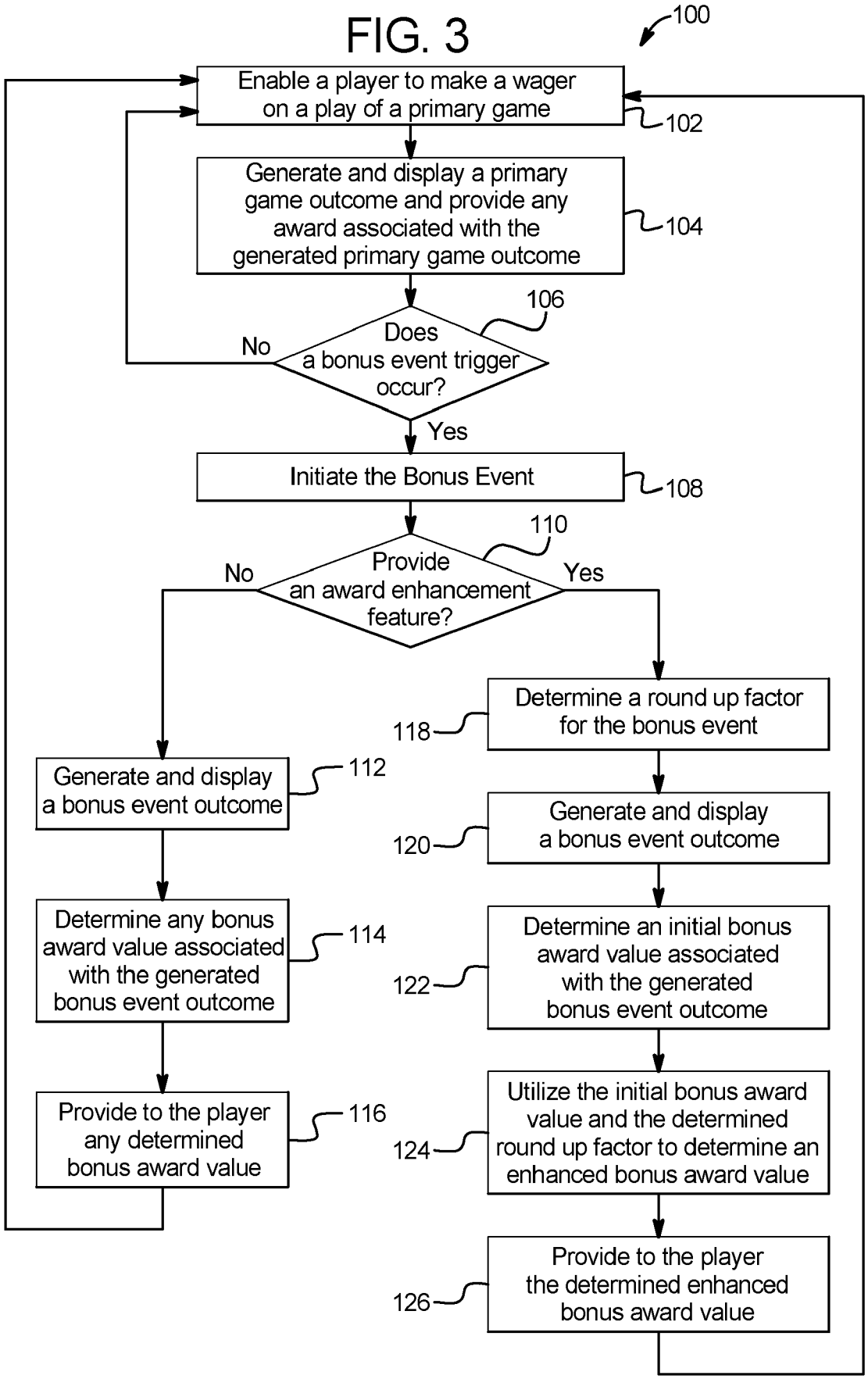
FIG. 3 is a flow chart illustrating one embodiment of the present disclosure.

Referring now to FIG. 3, in one embodiment, the gaming device or gaming system of the present disclosure operates according to sequence 100. In one embodiment, the gaming device includes at least one primary or base game operable upon a wager by a player. The gaming device can incorporate any suitable type of primary or base game, such as a slot game, a poker game, a blackjack game, a keno game, or a bingo game. The gaming device further includes a bonus event which is triggered upon an occurrence of a bonus event triggering event. The bonus event may be any suitable event or activity which provides a player with the opportunity to win an award.

As indicated by block 102, the gaming device enables a player to place a wager to play the primary game. Upon receiving the primary game wager, the gaming device generates and displays a primary game outcome. The gaming device determines whether any primary game awards are associated with the generated primary game outcome and provides any determined primary game awards to the player, as indicated by block 104.

At decision diamond 106, the gaming device determines if a bonus event triggering event occurs. If the bonus event triggering event does not occur, the gaming device enables the player to place another wager to initiate another play of the primary game, as indicated by block 102.

If the bonus event triggering event has occurred, the bonus event initiates, as indicated by block 108. The bonus event may be triggered by any suitable symbol-driven triggering event or other event based on primary game play or by a triggering event that randomly occurs independent of primary game play. In various embodiments, the triggering event may be based on but is not limited to at least one of: (i) an amount of time played on the gaming device; (ii) a random time of the day; (iii) an amount of money wagered on the gaming device; (iv) an amount of money lost at the gaming device; (v) an amount of money won at the gaming device; (vi) an amount of money wagered at games in a gaming system; (vii) an amount of money lost at the gaming devices in a gaming system; (viii) an amount of money won at the gaming devices in a gaming system; (ix) an event or outcome occurring in the primary game of one of the gaming devices; (x) an event occurring due to a shared random outcome generation; (xi) meeting one or more thresholds, such as a number of plays or a wager pool exceeding a designated amount; (xii) a random determination based on an amount wagered; (xiii) an occurrence of a predetermined event; (xiv) one or more side wagers placed; and (xv) any combination of these.

At decision diamond 110, the gaming device determines whether to provide the player with an award enhancement feature for the bonus event. In different embodiments, the gaming device determines whether to provide a player with the award enhancement feature, randomly, based on the player's wager, based on the player's status (via a player tracking system), based on a triggering event, based on time, based on any other suitable criteria, or based any combination of these. In one such embodiment, the gaming device determines whether a player will obtain the award enhancement feature for the bonus event based on the wager placed by the player on the play of the primary game. In one such embodiment, the gaming device provides the award enhancement feature for the bonus event if the player's primary game wager meets a minimum wager level. In one embodiment, this minimum wager level is the maximum wager level for the primary game. Thus, if the bonus event is triggered, the gaming device provides a player is with the award enhancement feature for the bonus event if that player placed the maximum wager on the primary game.

In another embodiment, to obtain the award enhancement feature for the bonus event, a player must place a separate side wager or side bet in addition to the primary game wager. In one such embodiment, the player must place the maximum bet and the side bet to obtain the award enhancement feature. In another embodiment, if the player places or wagers the required side bet, the player may wager at any level during the primary game (i.e., the player need not place the maximum bet and the side bet to obtain the bonus enhancement feature).

In another embodiment, the gaming device determines whether a player will obtain the award enhancement feature based on player status, such as via a player tracking system. For example, a player having gold status obtains the award enhancement feature each time the bonus event is triggered, while a player having bronze status does not always obtain the award enhancement feature when the bonus event is triggered.

Referring back to FIG. 3, if, at decision diamond 110, the gaming device determines not to provide the player with the award enhancement feature for the bonus event, the gaming device generates and displays an outcome for the bonus event, as indicated by block 112. The gaming device determines any bonus award value associated with the determined bonus event outcome, as indicated by block 114. The player is provided with any determined bonus award value, as indicated by block 116. At this point, the player can initiate another play of the primary game by placing another primary game wager on the game. If the player does not wish to continue playing, the player can cash out to obtain any credits or amounts won during game play.

If, at decision diamond 110, the gaming device determines to provide the player with the award enhancement feature for the bonus event, the gaming device determines or selects a round up factor that will apply in the bonus event, as indicated by block 118. The gaming device utilizes the round up factor to determine the enhanced bonus award value that will be provided to the player for the bonus event, as discussed below. In different embodiments, the round up factor selected for the bonus event may be predetermined, randomly determined, determined based on the player's wager, determined based on the player's status (via a player tracking system), determined based on a triggering event, determined based on time, or determined in any other suitable manner. In one example embodiment, the gaming device determines the round up factor for the bonus event based on the result of another event that the player participates in. In one example embodiment, once the bonus event is triggered the gaming device displays a selection set which includes a plurality of selections. Each of the selections is individually associated with one of a plurality of round up factors. The gaming device enables the player to pick a selection to obtain the round up factor associated with that selection, as discussed below in relation to FIGS. 4A to 4E.

In one embodiment, the selected or determined round up factor is an integer, such as one, two, three, five, or ten. Each round up factor is associated with a set of multiples. That is, each round up factor has a set of numbers that are multiples of that round up factor. For example, a round up factor of two is associated with a set of multiples including the numbers 2, 4, 6, 8, . . . 2n. A round up factor of five is associated with a set of multiples including the numbers 5, 10, 15, 20, . . . 5n. In another embodiment, the round up factor is a fractional amount, such as ½ or ¼.

After the gaming device determines the round up factor that will apply in the bonus event, the gaming device generates and displays an outcome for the bonus event, as indicated by block 120. The gaming device determines any initial bonus award value based on the generated bonus event outcome, as indicated by block 122. It should be appreciated that the initial bonus award value is the award associated with the bonus event outcome, such as according to a paytable employed in the bonus event. However, if a player obtains a round up factor for the bonus event, the initial bonus award value is not the bonus award value that is actually provided to the player. As indicated in block 124, the gaming device utilizes the determined initial bonus award value and the round up factor to determine an enhanced bonus award value. After determining the enhanced bonus award value, the gaming device provides the determined enhanced bonus award value to the player, as indicated by block 126.

In one embodiment, the gaming device determines the enhanced bonus award value by rounding the initial bonus award value up to a next higher multiple of the selected round up factor. For example, if a player is provided with a round up factor of two and wins an initial bonus award value of $6.50, the enhanced bonus award value provided to the player is $8.00. That is, the initial bonus award value of $6.50 is rounded up to the next higher multiple of two (i.e., the next higher two-dollar increment), to determine the enhanced bonus award value. In this example, by obtaining the round up factor of two for the bonus event, the player wins an enhanced bonus award (i.e., $8.00) that is $1.50 more than the initial bonus award (i.e., $6.50). It should be appreciated that any of the above embodiments could provide a round down factor. In such embodiments, the gaming device determines or selects a round down factor which causes any initial bonus award value to be rounded down to a lower value. The round down factor could be selected in any suitable manner.

In one embodiment, the present disclosure thus provides an award enhancement feature which enables enhancing an initial bonus award value resulting from a bonus event based on a round up factor. The gaming system performs one or more random determinations to determine the initial bonus award value and performs an additional determination to determine the round up factor. The additional determination to determine the round up factor may be predetermined, randomly determined, or player determined.

It should be appreciated that, in the example embodiment of FIG. 3, when a player obtains the round up factor for the bonus event, the round up factor does not apply to any award (s) won in the primary game. Rather, the round up factor takes effect in the bonus event to enhance any bonus award resulting from the bonus event. However, in alternative embodiments, the award enhancement feature may be employed to enhance any award(s) won in a primary game.

It should also be appreciated that the amount by which the initial bonus award value changes (and preferably increases) depends on both the value or size of the selected round up factor, as well as the initial bonus award value. Elaborating on the example above, if, instead of obtaining a round up factor of two for the bonus event, the player obtains a round up factor of five, the initial bonus award value of $6.50 rounds up to the next higher five-dollar increment, or $10.00. Thus, the player wins an enhanced bonus award that is $3.50 more than the initial bonus award value of $6.50. In this case, the higher round up factor of five causes the initial bonus award value of $6.50 to increase by a larger amount than the round up factor of two. If, on the other hand, the initial bonus award value had been $8.50, both of the round up factors—two or five—would result in an increase of $1.50 to the initial bonus award value.

That is, applying a round up factor of two to the $8.50 award causes it to round up to $10.00. Applying a round up factor of five to the same award also causes it to go up to $10.00. Relative to the initial bonus award value of $8.50, ten is the next higher multiple of both two and five. Thus, in this case, each of the different round up factors results in the same increase to the initial bonus award value. Continuing this example, if the initial bonus award value had been $4.50, the round up factor of five would result in a smaller increase to the initial bonus award value than the round up factor of two. The round up factor of five causes the initial bonus award value to increase to $5.00. The round up factor of two causes the initial bonus award value to increase to $6.00.

Accordingly, as demonstrated by these examples, obtaining a higher round up factor does not necessarily mean that a player's initial bonus award value will increase by a larger amount. Rather, the amount by which the initial bonus award value increases depends on both the round up factor and the initial bonus award value that is being enhanced or adjusted.

It should further be appreciated that one, more or all of the digits of the initial bonus award value may change depending on the round up factor selected and applied in the bonus event. For example, a bonus event results in an initial bonus award value of $10.34. If a round up factor of one applies in this bonus event, the enhanced bonus award value is determined by rounding up the initial bonus award value (i.e., $10.34) to the next higher one-dollar increment, or $11.00. In this case, each of the digits in the initial bonus award value is modified or changed. If, instead, the round up factor is 0.5 (i.e., fifty cents), the enhanced bonus award value is determined by rounding up the initial bonus award value of $10.34 to $10.50. In this case, only the digits occupying the tenths place and hundredths place (i.e., the 3 and the 4) are modified in determining the enhanced bonus award value.

In one embodiment, each round up factor is associated with a specific digit place of a numeral (e.g., the ones place, the tens place, the tenths place, etc.) and modifies only the digit occupying that place. For example, a player obtains a round up factor of two, which applies to the tens place of any award won in the bonus event. If the player's initial bonus award value is $10.34, the digit in the tens place of $10.34 (i.e., the one) is rounded up to the next higher multiple of two. Accordingly, the enhanced bonus award value provided to the player is $20.34. In another example, a player obtains a round up factor of two, which applies to the tenths place of the award won in the bonus event. The digit in the tenths place of the initial bonus award value of $10.34 (i.e., the three) is rounded up to the next higher multiple of two. This results in an enhanced bonus award value of $10.44.

In one embodiment, a round up factor does not include a specific integer or number, but rather determines whether a player's initial bonus award value will be rounded up to a next higher even number or a next higher odd number. If a player obtains an "even number" round up factor, the gaming device rounds the initial bonus award value up to the next higher even number. For example, if the player wins an initial bonus award value of $7.00, the enhanced bonus award value provided to the player is $8.00. If the player obtains an "odd number" round up factor, the gaming device rounds the initial bonus award value up to the next higher odd number. For example, if the player wins an initial bonus award value of $7.00, the enhanced bonus award value provided to the player is $9.00.

Referring now to FIGS. 4A, 4B, 4C, 4D, 4E, and 4F, an example of one embodiment of the present disclosure is illustrated wherein, if the bonus event is triggered, the gaming device provides a player with a number of free activations (or free spins) of a game for the bonus event. In the illustrated embodiment, if the player's wager meets a designated wager level, such as twenty credits, the gaming device displays a selection sequence. The gaming device determines a round up factor for the bonus event based on the result of the selection sequence. In one embodiment, the selected round up factor applies to the total value of the bonus awards accumulated in all of the free activations of the bonus event, as discussed below in relation to FIG. 5A. In another embodiment, the selected round up factor applies to any bonus award value resulting from each activation, as discussed below in relation to FIG. 5B.

Figure 4A:
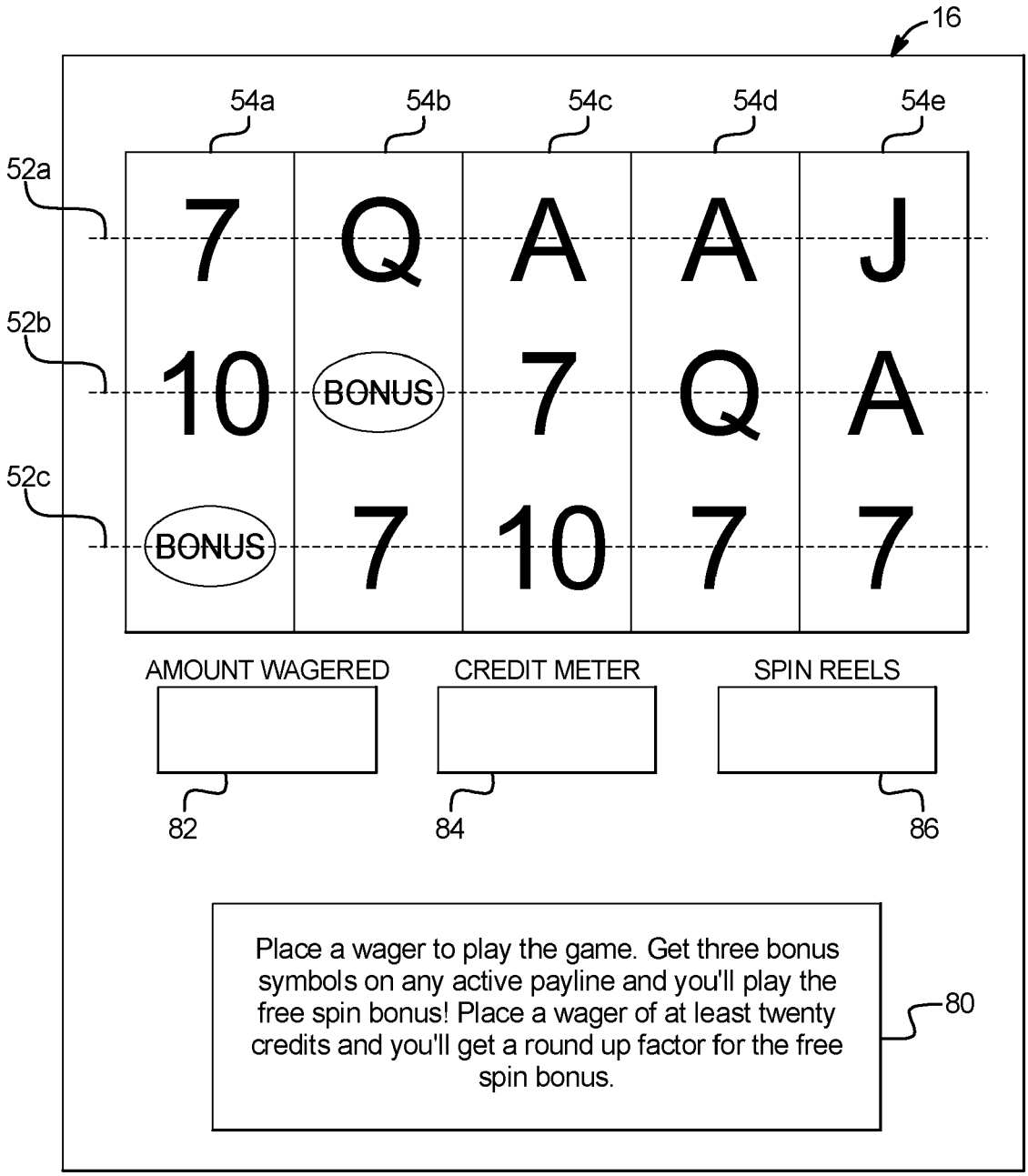
FIGS. 4A, 4B, 4C, 4D, 4E, and 4F are screen shots illustrating an example embodiment of the present disclosure.

As seen in FIG. 4A, the display device 16 displays a primary game, and more particularly a slot game, which includes a plurality of reels 54*a*, 54*b*, 54*c*, 54*d*, and 54*e*, each of the reels including a plurality of symbols. It should be appreciated that the reels may be cascading reels, independent reels, dependent reels, or any other suitable type of reels. It should also be appreciated that the primary game is not limited to a slot game and may be any game operable on a wager, such as poker, blackjack, craps, keno, bunco, and any other suitable wagering game. In this example, when the bonus event is triggered, the gaming device provides the player with a number of free activations of the reels 54*a*, 54*b*, 54*c*, 54*d*, and 54*e*.

The gaming device includes an amount wagered meter 82, a credit meter 84, and a SPIN REELS button 86. The gaming device further includes a message display 80. In this example, the message display 80 communicates information regarding game status and outcomes to the players. It should be appreciated that the message display 80 may be used for any suitable purpose. As seen in FIG. 4A, the gaming device displays a message in message box 80 prompting the player to make a wager to start playing the primary game. The gaming device also informs the player that placing a wager of at least twenty credits enables the player to obtain a round up factor for the bonus event.

Figure 4B:
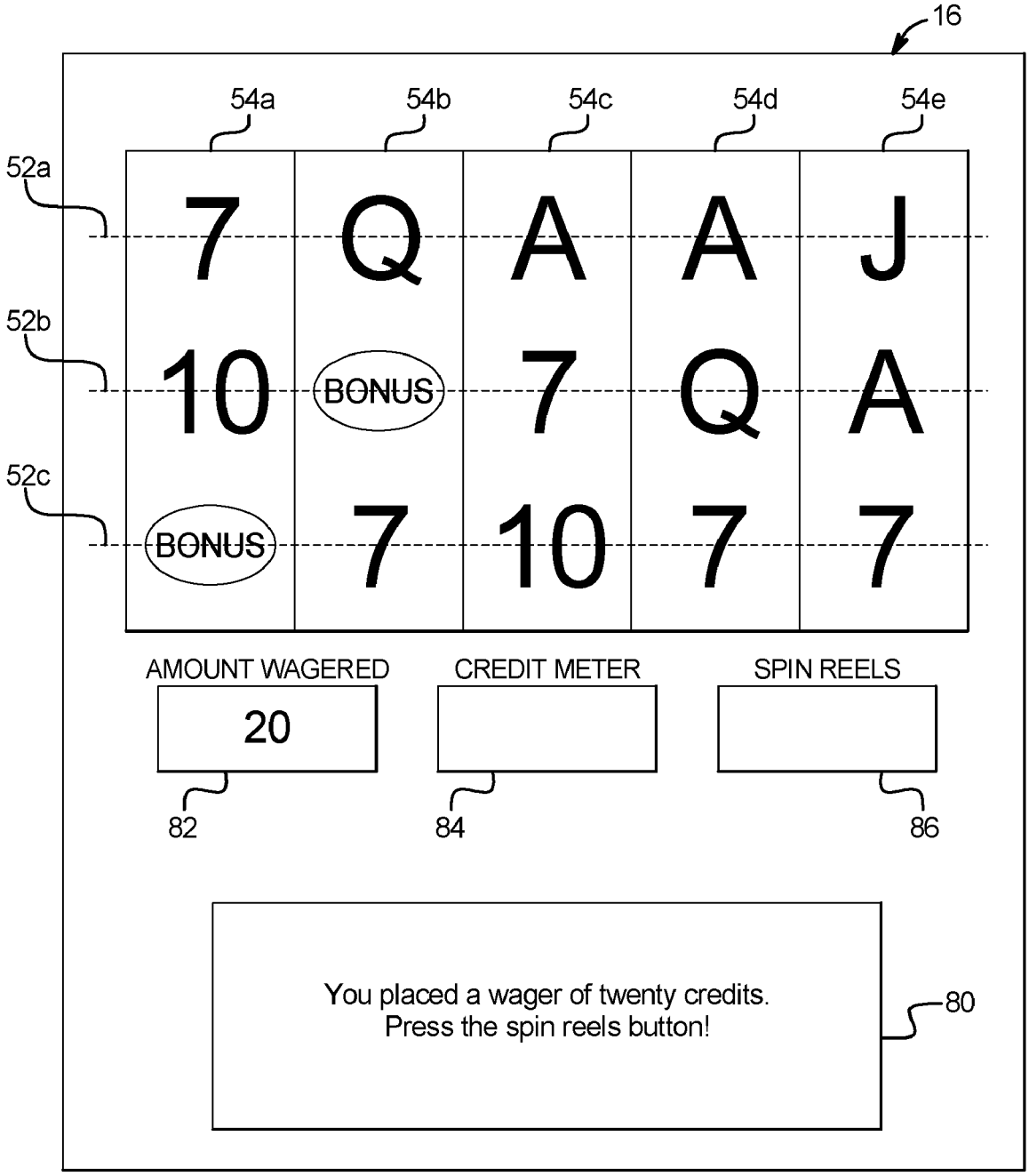

In FIG. 4B, the player has placed a wager of twenty credits on the primary game, as indicated by the message display 80. Also, the amount wagered meter 82 shows the number twenty to reflect the wager amount placed by the player. The gaming device prompts the player to press the SPIN REELS button 86 to activate the reels for the first time.

Figure 4C:
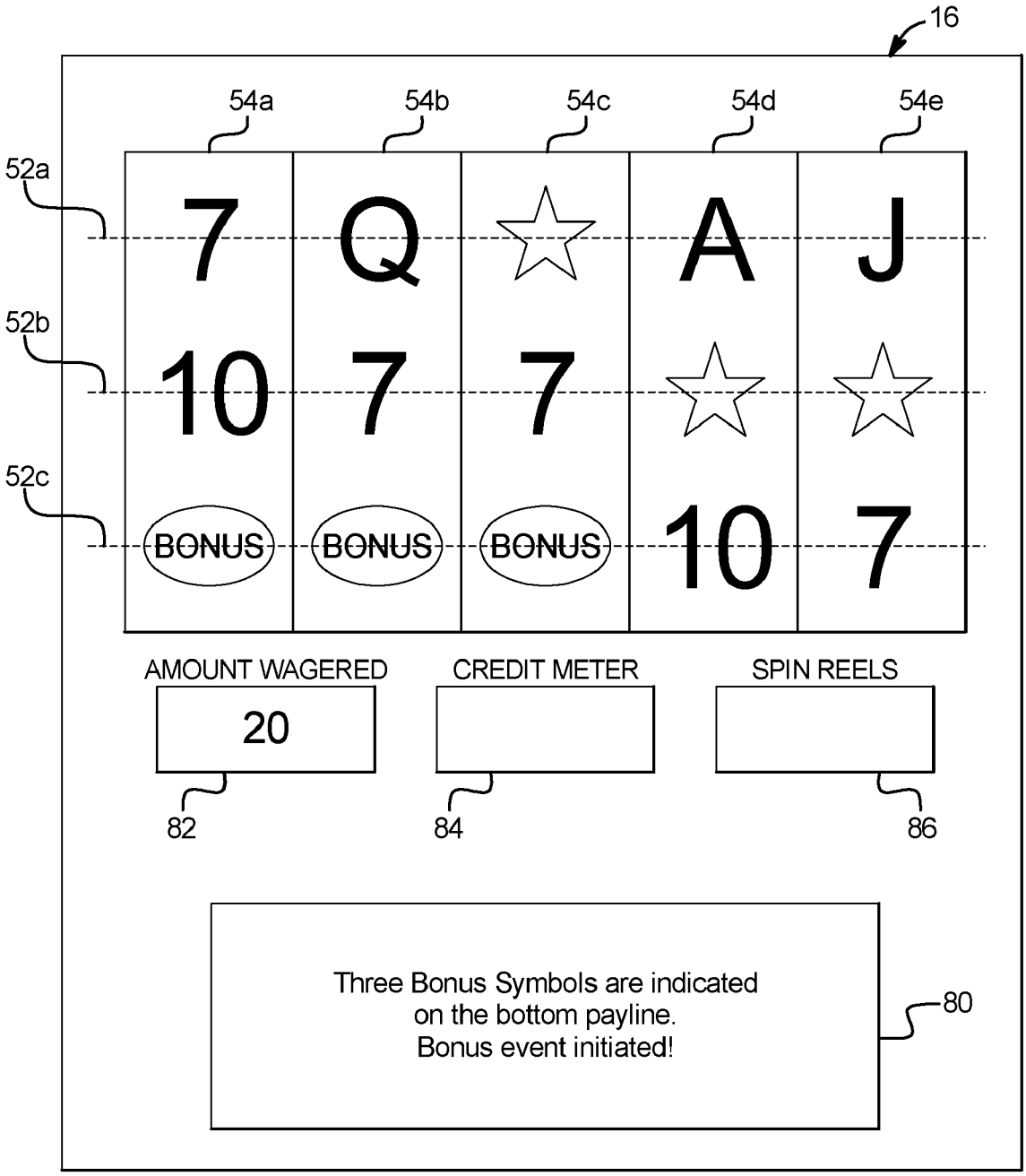

As illustrated in FIG. 4C, after the reels spin, the gaming device determines whether any winning symbol combinations are indicated along any of the paylines 52*a*, 52*b*, and 52*c*. As indicated by the message display 80, the bottom payline 52*c* indicates a symbol combination which includes three BONUS symbols. This symbol combination is the bonus triggering event. Accordingly, the gaming device displays a message in the message display 80 indicating that the bonus event is initiating.

Figure 4D:
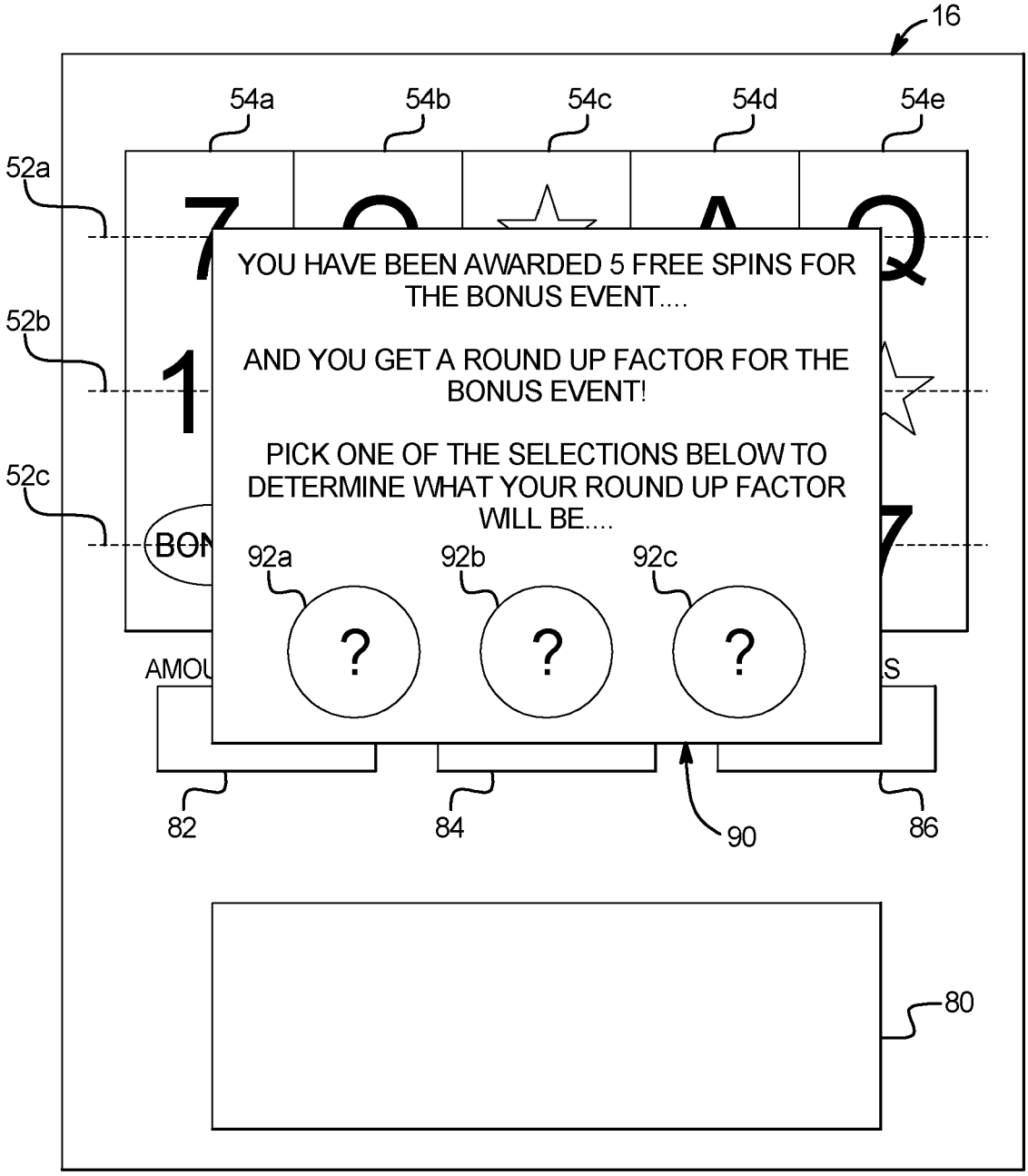

As illustrated in FIG. 4D, a selection sequence window 90 appears on the display device 16. In the illustrated embodiment, the window utilizes a portion of a main display device of the gaming device. More specifically, the window is displayed on the main display device, such that it overlaps with or covers a portion of the primary game elements. In other embodiments, the window is displayed adjacent to the main window of the display device.

In FIG. 4D, the selection sequence window 90 displays information relating to the bonus event. For example, the selection sequence window 90 indicates that the player has been awarded five free activations of the reels for the bonus event. It should be appreciated that, in various different embodiments, the number of free activations provided for the bonus event may be predetermined, randomly determined, determined based on the player's wager, determined based on the player's status (via a player tracking system), determined based on a triggering event, determined based on time, or determined in any other suitable manner.

The selection sequence window 90 also displays three masked selections 92*a*, 92*b*, 92*c*. In the illustrated embodiment, the selections are circle-shaped. It should be appreciated that the gaming device can display any suitable number of selections and the selections may be of any suitable size or shape. Each of the masked selections 92*a*, 92*b*, 92*c* is associated with a round up value, which is initially concealed or hidden from the player.

The gaming device prompts the player to pick one of the selections 92*a*, 92*b*, 92*c* to determine which round up factor will apply for the bonus event, as indicated by the selection sequence window 90. In certain embodiments, the selection sequence window 90 is utilized to display the masked selections to the player and to receive player inputs from input devices coupled to the gaming device, such as a touch screen. In such embodiments, a player can utilize the selection sequence window 90 to input a selection of one of the masked selections.

Figure 4E:
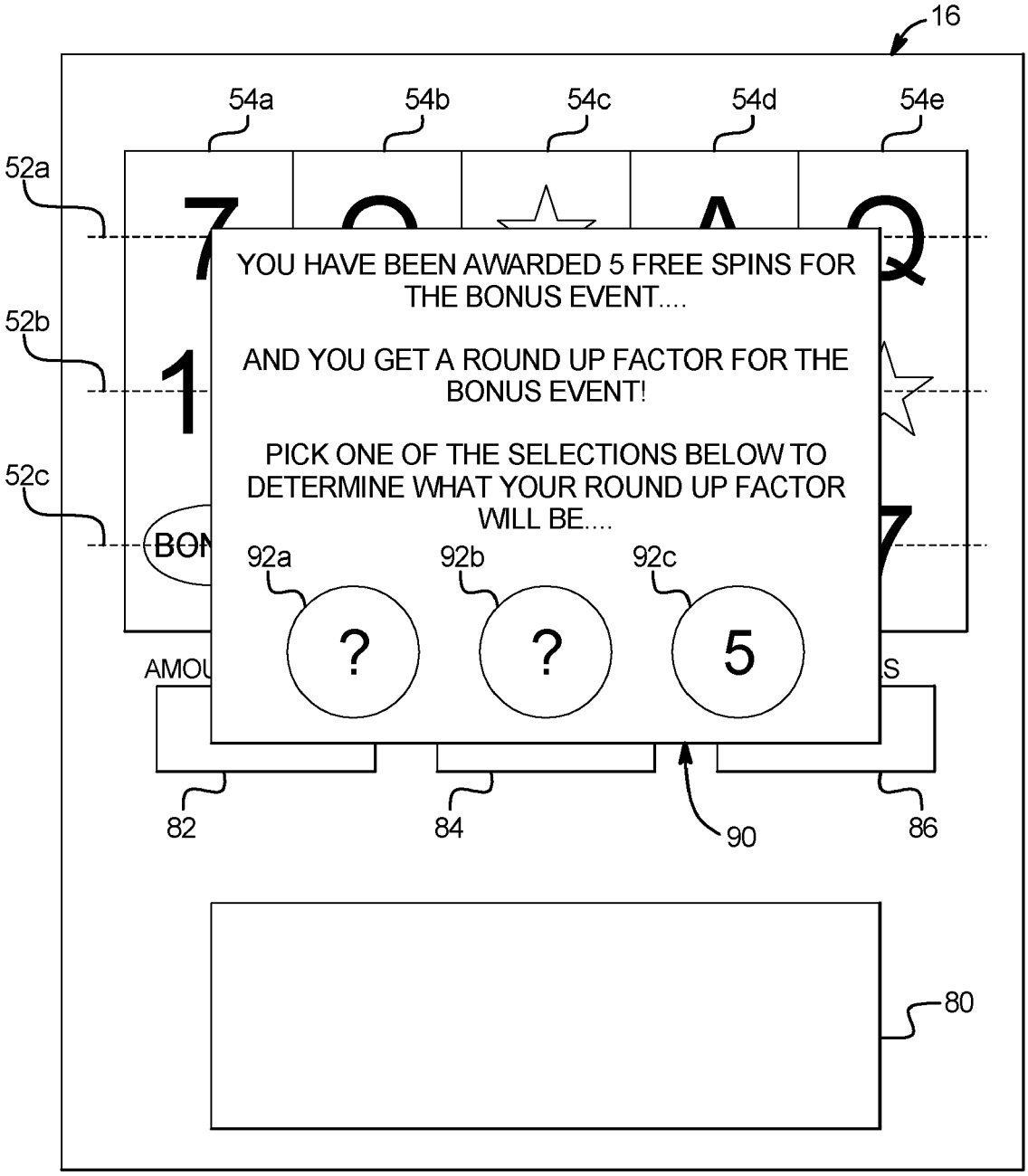

As illustrated in FIG. 4E, the player picked the third selection 92*c*. As a result, the round up factor associated with that selection 92*c* is revealed. The round up factor that will apply for the bonus event is five, as indicated in the selection sequence window 90.

Thus, the selection sequence is a separate event that the player participates in to determine what the round up factor will be for the bonus event. In this example, since the player's wager of twenty credits meets the designated wager level, the player is eligible to participate in the selection sequence and to obtain a round up factor for the bonus event. It should be appreciated that, as discussed above, whether the player obtains a round up factor for the bonus event (i.e., whether the player has the chance to participate in the selection sequence) may be determined in any suitable manner.

Figure 4F:
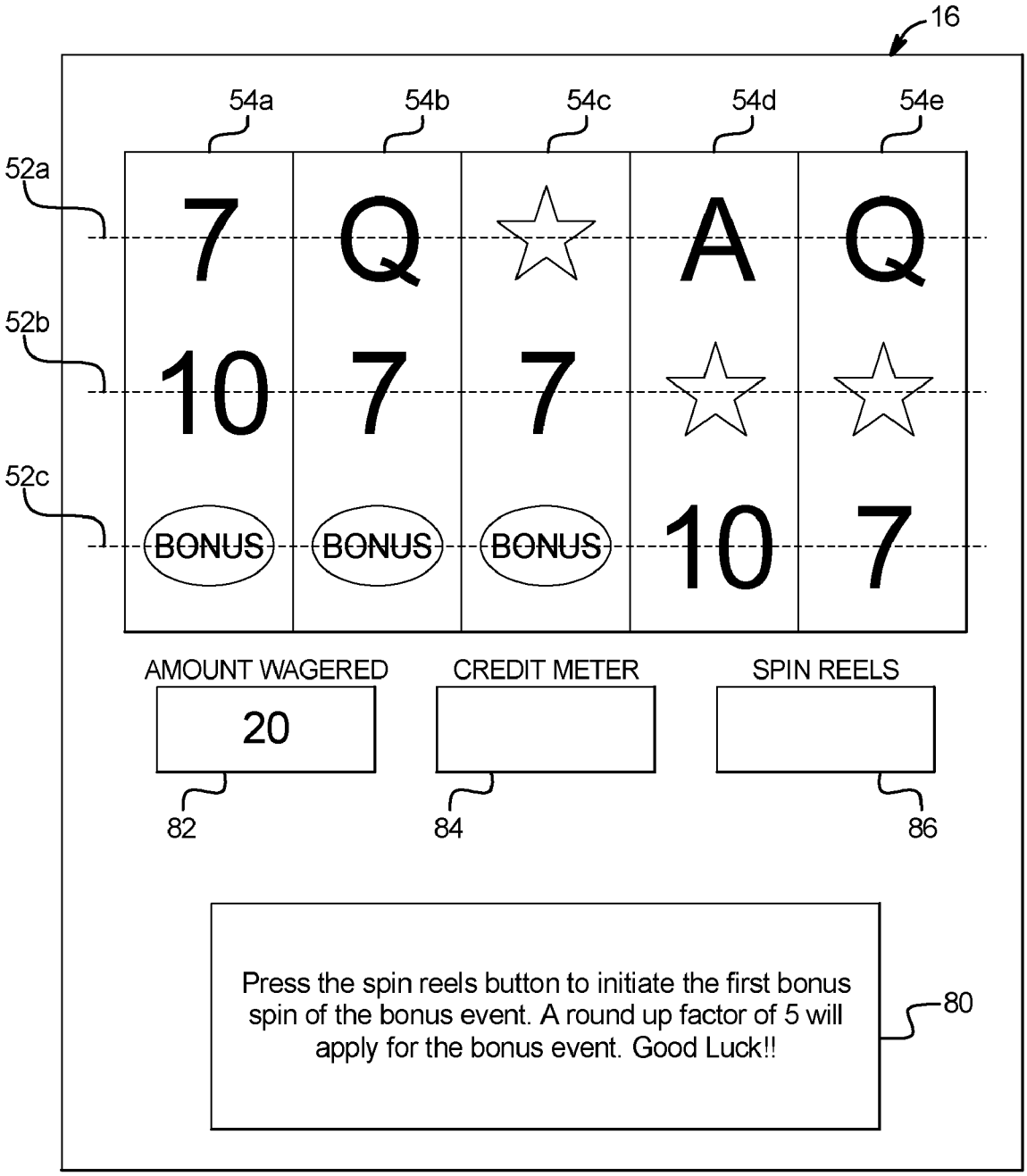

As illustrated in FIG. 4F, after the round up factor for the bonus event is determined, the selection sequence window 90 disappears, and the player has full view of the reels 54*a*, 54*b*, 54*c*, 54*d*, and 54*e*. The gaming device prompts the player to press the SPIN REELS button 86 to initiate the first of the five free activations or spins for the bonus event. The gaming device reminds the player that a round up factor of five will apply in the bonus event, as indicated by the message display 80.

FIG. 5A provides a table 200*a* which illustrates the results of the five free activations of the bonus event in accordance with one example embodiment of the present disclosure. In this example embodiment, the round up factor selected for the bonus event (i.e., five) applies to the total bonus award value accumulated at the end of the bonus event. That is, after the five free activations occur, any bonus award values resulting from those free activations are accumulated. The accumulated or total value of all bonus awards resulting from the five free activations is enhanced based on the selected round up factor. More specifically, the total value of all bonus awards resulting from the five free activations is rounded up to the next higher multiple of the round up factor.

As illustrated in table 200*a*, the five free activations resulted in a total initial bonus award value of $36.95. Since the player obtained a round up factor of five, the gaming device determines the enhanced bonus award value by rounding the initial award value of $36.95 to the next higher multiple of five. In this case, the next higher multiple of five which occurs after the number 36.95 is 40. The enhanced bonus award value is therefore $40.00. Accordingly, in this example, the player obtains an enhanced bonus award having a value that is $3.05 higher than the initial bonus award value.

FIG. 5B provides a table 200*b* which illustrates the results of the five free activations of the bonus event in accordance with another example embodiment of the present disclosure. In the example embodiment illustrated by FIG. 5B, the round up factor selected for the bonus event (i.e., five) applies to the initial bonus award value resulting from each activation. For example, the first free activation resulted in an initial bonus award value of $1.50. The enhanced bonus award value for this free activation is therefore $5.00. For the last free activation, the resulting initial bonus award value was $16.00. The enhanced bonus award value for this free activation is therefore $20.00. Overall, the bonus event results in a total bonus award of $55.00 for the player. If the player had not obtained the round up factor, the bonus event would only have resulted in a bonus award of $36.95 for the player. Accordingly, obtaining the round up factor enabled the player to enhance the bonus award by $18.05.

In another embodiment, a player can purchase the award enhancement feature, such as by paying a fee. In one such embodiment, if the player pays the fee to obtain the round up factor, the gaming device determines a round up factor which enhances any award won by a player in one or more games. In one embodiment, the player determines how many games to which the purchased round up factor will apply. In one such embodiment, the amount of the fee required to purchase the round up factor is based on how many games the round up factor will apply to. In another embodiment, the player selectively determines which games to apply the round up factor to. In different embodiments, a purchased round up factor could apply to any award(s) won in a primary game, any award(s) won in a bonus game, or both.

In the above embodiments, the initial bonus award values and enhanced bonus award values include dollar amounts. It should be appreciated that, however, that any of these embodiments could be implemented using credits or credit amounts.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming system comprising:

at least one input device;

at least one display device;

at least one processor; and at least one memory device which stores a plurality of instructions, which when executed by the at least one processor, cause the at least one processor to operate with the at least one input device and the at least one display device to:

(a) enable a player to place a primary game wager on a play of a primary game;

(b) generate and display a primary game outcome;

(c) determine any award associated with the generated primary game outcome; and (d) if a bonus event triggering event occurs:

(i) initiate a bonus event, (ii) if a designated wager amount condition associated with the play of the primary game is met, determine a round up factor from a plurality of different round up factors for the bonus event, each said round up factor respectively associated with a different set of multiples, (iii) generate and display a bonus event outcome, (iv) determine an initial bonus award value associated with the generated bonus event outcome, (v) if one of the round up factors is determined for the bonus event:

(A) determine an enhanced bonus award value by rounding up the initial bonus award value to a next higher multiple from the set of multiples associated with the determined round up factor relative to the initial bonus award value, and (B) display and provide the enhanced bonus award value to the player, and (vi) if one of the round up factors is not determined for the bonus event, display and provide the initial bonus award value to the player.

2. The gaming system of claim 1, wherein the designated wager amount condition is met if the primary game wager meets a designated wager level for the play of the primary game.

3. The gaming system of claim 2, wherein the designated wager level includes a maximum primary game wager.

4. The gaming system of claim 1, wherein the designated wager amount condition is met if a separate side wager is placed in addition to the primary game wager.

5. The gaming system of claim 1, wherein the round up factor for the bonus event is determined based on a result of a selection sequence, wherein the plurality of instructions, when executed by the at least one processor, cause the at least one processor to provide said selection sequence by:

(i) displaying a plurality of masked selections to the player, each of said selections associated with one of said round up factors, and (ii) enabling the player to pick one of said masked selections, wherein the round up factor associated with the selection picked by the player is the determined round up factor.

6. The gaming system of claim 1, wherein the bonus event includes a plurality of free activations of a secondary game.

7. The gaming system of claim 6, wherein the plurality of instructions, when executed by the at least one processor, cause the at least one processor, for each of said free activations of the secondary game, to generate and display a secondary game outcome and determine an initial bonus award value associated with the generated secondary game outcome.

8. The gaming system of claim 7, wherein, if one of the round up factors is determined for the bonus event, the plurality of instructions, when executed by the at least one processor, cause the at least one processor, for each of the free activations of the secondary game, to determine an enhanced bonus award value by rounding up the initial bonus award value to a next higher multiple of the determined round up factor relative to the initial bonus award value, and display and provide the enhanced bonus award value to the player.

9. The gaming system of claim 7, wherein, if one of the round up factors is determined for the bonus event, the plurality of instructions, when executed by the at least one processor, cause the at least one processor to:

(i) determine a total bonus award value based on the initial bonus award values associated with the generated secondary game outcomes for said free activations, (ii) determine an enhanced total bonus award value by rounding up the total bonus award value to a next higher multiple of the determined round up factor relative to the total bonus award value, and (iii) display and provide the enhanced total bonus award value to the player.

10. The gaming system of claim 6, wherein the primary game and the secondary game are the same game.

11. The gaming system of claim 6, wherein the primary game and the secondary game are different games.

12. A gaming system comprising:

at least one input device;

at least one display device;

at least one processor; and at least one memory device which stores a plurality of instructions, which when executed by the at least one processor, cause the at least one processor to operate with the at least one input device and the at least one display device to:

(a) enable a player to place a primary game wager on a play of a primary game;

(b) generate and display a primary game outcome;

(c) determine any award associated with the generated primary game outcome; and (d) if a bonus event triggering event occurs:

(i) initiate a bonus event, (ii) determine a round up factor from a plurality of different round up factors for the bonus event, each said round up factor respectively associated with a different set of multiples, (iii) generate and display a bonus event outcome, (iv) determine an initial bonus award value associated with the generated bonus event outcome, (v) determine an enhanced bonus award value by rounding up the initial bonus award value to a next higher multiple from the set of multiples associated with the determined round up factor relative to the initial bonus award value, and (vi) display and provide the enhanced bonus award value to the player.

13. The gaming system of claim 12, wherein the round up factor is determined for the bonus event based on a result of a selection sequence, wherein the plurality of instructions, when executed by the at least one processor, cause the at least one processor to provide said selection sequence by:

(i) displaying a plurality of masked selections to the player, each of said selections associated with one of said round up factors, and (ii) enabling the player to pick one of said masked selections, wherein the round up factor associated with the selection picked by the player is the determined round up factor.

14. The gaming system of claim 12, wherein the bonus event includes a plurality of free activations of a secondary game.

15. The gaming system of claim 14, wherein the plurality of instructions, when executed by the at least one processor, cause the at least one processor, for each of said free activations of the secondary game, to:

(i) generate and display a secondary game outcome and determine an initial bonus award value associated with the generated secondary game outcome, (ii) determine an enhanced bonus award value by rounding up the initial bonus award value to a next higher multiple of the determined round up factor relative to the initial bonus award value, and (iii) display and provide the enhanced bonus award value to the player.

16. The gaming system of claim 14, wherein the plurality of instructions, when executed by the at least one processor, cause the at least one processor to:

(i) for each of said free activations of the secondary game, generate and display a secondary game outcome and determine an initial bonus award value associated with the generated secondary game outcome, (ii) determine a total bonus award value based on the initial bonus award values associated with the generated secondary game outcomes for said free activations, (iii) determine an enhanced total bonus award value by rounding up the total bonus award value to a next higher multiple of the determined round up factor relative to the total bonus award value, and (iv) display and provide the enhanced total bonus award value to the player.

17. The gaming system of claim 14, wherein the primary game and the secondary game are the same game.

18. The gaming system of claim 14, wherein the primary game and the secondary game are different games.

19. A gaming system comprising:

at least one input device;

at least one display device;

at least one processor; and at least one memory device which stores a plurality of instructions, which when executed by the at least one processor, cause the at least one processor to operate with the at least one input device and the at least one display device to:

(a) determine and display an outcome for a play of a wagering game;

(b) determine an initial award value associated with the determined outcome;

(c) determine whether to apply a round up factor to the initial award value;

(d) if the determination is to apply the round up factor to the initial award value:

(i) select the round up factor by displaying a plurality of masked selections, each of said selections associated with one of a plurality of different round up factors, and enabling a player to pick one of said masked selections, wherein the round up factor associated with the selection picked by the player is the round up factor to be applied to the initial award value, (ii) determine an enhanced award value based on the picked round up factor and applied to the initial award value, and (iii) display and provide the enhanced award value to the player; and (e) if the determination is not to apply the round up factor to the initial award value, display and provide the initial award value to the player.

* * * * *